US005282740A

United States Patent [19]

Okayasu

[11] Patent Number: 5,282,740

[45] Date of Patent: Feb. 1, 1994

[54] PORTABLE HEAT CONDUCTING APPARATUS

[76] Inventor: Kenji Okayasu, 20-15, Muko-machi, Gyoda-shi, Saitama-ken, Japan

[21] Appl. No.: 886,408

[22] Filed: May 21, 1992

[30] Foreign Application Priority Data

May 22, 1991 [JP] Japan ..... 3-117283

[51] Int. Cl.[5] ..... F23D 14/28; A61F 7/00

[52] U.S. Cl. ..... 431/344; 431/328; 126/204; 126/210

[58] Field of Search ..... 126/204, 208, 210, 344, 126/373; 165/46; 431/344, 328, 329

[56] References Cited

U.S. PATENT DOCUMENTS

| | | | |
|---|---|---|---|
| 2,652,824 | 9/1953 | Hopp | 126/208 |
| 2,755,792 | 7/1956 | Van Hook | 126/210 |
| 2,996,062 | 8/1961 | Weiss | 126/204 |
| 3,034,495 | 5/1962 | Bernard | 126/210 |
| 3,112,792 | 12/1963 | Coleman et al. | 126/204 |
| 3,153,720 | 10/1964 | Petronio et al. | 126/204 |
| 3,211,216 | 10/1965 | Coleman et al. | 126/204 |
| 3,367,319 | 2/1968 | Carter, Jr. | 126/204 |
| 3,406,678 | 10/1968 | Hanks | 126/208 |
| 3,450,127 | 6/1969 | Harwood | 126/204 |
| 3,513,824 | 5/1970 | Fitzgerald et al. | 126/204 |
| 3,536,059 | 10/1970 | Hearst et al. | 126/204 |
| 3,558,852 | 1/1971 | Larenzo et al. | 126/204 |
| 3,569,669 | 3/1971 | March | 126/204 |
| 3,644,706 | 2/1972 | Larenzo et al. | 126/204 |
| 3,680,563 | 8/1972 | Forrest | 128/402 |
| 3,737,620 | 6/1973 | Harvey | 126/204 |
| 4,294,225 | 10/1981 | Mayo | 126/204 |
| 4,480,590 | 11/1984 | Rhodin | 126/204 |
| 4,625,790 | 12/1986 | Okayasu | 165/104.22 |
| 4,685,442 | 8/1987 | Cieslak | 126/204 |
| 4,792,283 | 12/1988 | Okayasu | 417/209 |

FOREIGN PATENT DOCUMENTS

| | | |
|---|---|---|
| 0260242 | 3/1988 | European Pat. Off. . |
| 1183387 | 1/1959 | France . |
| 2080146 | 11/1971 | France . |
| 2-109501 | 4/1990 | Japan . |
| 0005663 | 10/1986 | PCT Int'l Appl. . |
| WO8102195 | 8/1981 | World Int. Prop. O. . |

*Primary Examiner*—James C. Yeung
*Attorney, Agent, or Firm*—Cushman, Darby & Cushman

[57] ABSTRACT

A portable heat conducting apparatus which includes a gas catalyst combustion device having an air sucking ejector. The apparatus further includes a gas jetting nozzle connected to a gas cylinder via a gas control valve, a combustion catalyst, an ignition device, heat drive pump, and check valve. The heat drive pump includes a heating portion having a liquid heating recess. A check valve is disposed in each of the discharge and suction sides of the apparatus. The gas catalyst combustion device has a combustion chamber which accommodates the combustion catalyst, includes the heat drive pump's heating portion, and is made of excellent heat conducting material. An opening portion in the recess formed in the heat drive pump's heating portion is located to face upwards with respect to gravity, and the heat conducting apparatus further includes an operating-liquid circulating closed-circuit.

19 Claims, 11 Drawing Sheets

PORTABLE HEAT CONDUCTING APPARATUS

BACKGROUND OF THE INVENTION

1. Field of the Invention

The present invention relates to an application of "HEAT CONDUCTING APPARATUS" disclosed in Japanese Patent Application No. 59-153442 and "HEAT DRIVE PUMP" disclosed in Japanese Patent Application No. 61-144783 by the applicant of the present invention. More particularly, the present invention relates to a small-size and light weight heat conducting apparatus which can be utilized in a portable heating unit or a heating suit for use outdoors, the heat conducting apparatus having an energy source so that it can be utilized in highlands, on the sea, and cold districts, and the like, to which power or gas cannot be easily supplied.

2. Description of Related Art

Hitherto, gas stoves or body warmers, the energy source of each of which is petroleum type fuel, have been widely used as outdoor portable heaters. However, the stove is dangerous because it is an open fire system. Furthermore, since the stove scatters the major portion of its energy into the air, the energy is not used efficiently. The body warmer encounters a problem that it can heat only a portion. Accordingly, a heating suit and a mat each having a battery and an electric heat structure have been considered. However, the realized energy density per unit weight of the battery has not been satisfactory at present; and therefore, they cannot supply sufficient energy to the suit for a satisfactorily long time. If the structure is arranged in such a manner that it is able to supply sufficiently large energy for a satisfactorily long time, the weight of the structure becomes too heavy, according to the present technological level, causing a problem with carrying the device.

SUMMARY OF THE INVENTION

By using petroleum type fuel having significantly higher energy density than that of a battery, the problems encountered when using a battery, that energy cannot be supplied for a sufficiently long time by a satisfactorily large quantity, can be overcome. Furthermore, by applying the heat conducting apparatus invented by the applicant of the present invention, heat energy obtained from combustion of fuel can be supplied to the overall body of a subject to be heated. Therefore, the problems of energy loss experienced with the stove or the like, and heating only a portion can be heated can be overcome. During the development, utilization of a the gas catalyst combustion apparatus which uses the LPG, which has been used as a heat source in a hair curler or a soldering iron, was considered. However, the apparatus which is intended to be realized according to the present invention can be operated stably for a long time at a higher efficiency as compared with the hair curler or the like. Accordingly, the following structure must be realized and the problems must be overcome; a method of efficiently conducting thermal energy of combustion to a heat drive pump and a layout which enables the heat drive pump to be operated satisfactorily, a method of recovering the exhaust heat by utilizing a heat exchanger, a method of processing the drain, a method of correcting the change in the internal pressure of the circulating liquid closed-circuit, a method of controlling the output, a method of heat shielding and a measurement against lowering of cylinder pressure due to the heat of vaporization of the gas.

Therefore, an object of the present invention is to provide a portable heat conducting apparatus capable of overcoming all of the above described problems and which can be used in a heater and a heating suit, and the like.

According to the present invention, there is provided a portable heat conducting apparatus comprising a gas catalyst combustion device having an air sucking ejector including a gas jetting nozzle connected to a gas cylinder via a gas control valve, a combustion catalyst and an igniting device and the like a heat drive pump including a heating portion having a liquid heating recess, and a check valve in each of the discharge side thereof and the suction side thereof, the gas catalyst combustion device having a combustion chamber made of excellent heat conducting material, which accommodates the combustion catalyst, and which includes the heat drive pump heating portion, and an opening portion in the recess formed in the heat drive pump heating portion being located to face upwards with respect to gravity in a state where the apparatus is used, normally, and an operating-liquid circulating closed-circuit composed by connecting a feed tank, the heat drive pump and the external subject to be heated in series.

When the gas supplied from the gas cylinder is jetted from the gas jetting nozzle, outer air is sucked by the ejector so that a mixture mixed with the gas is prepared. In the combustion chamber of the gas catalyst combustion device, the introduced mixture, gas, is burnt by using the internal combustion catalyst so as to heat the heating portion of the heat drive pump. Bubbles of the operating liquid generated in the liquid heating recess is grown toward the gas liquid exchanging chamber, so that the discharge side check valve is opened while closing the suction side check valve. The operating liquid heated by a degree corresponding to the volume of the steam bubbles is circulated through the external subject to be heated. On the other hand, the steam bubbles are cooled down in the gas liquid exchanging chamber and are therefore condensed, resulting in that it disappears. The operating liquid, corresponding to the volume of the steam bubble which has disappeared. is introduced into the heat drive pump from the feed tank via the suction side check valve.

BRIEF DESCRIPTION OF THE DRAWINGS

The object and advantages of the present invention will become apparent from the following descriptions taken with reference to the accompanying drawings in which.

DETAILED DESCRIPTION OF THE EMBODIMENTS

Figure 1:
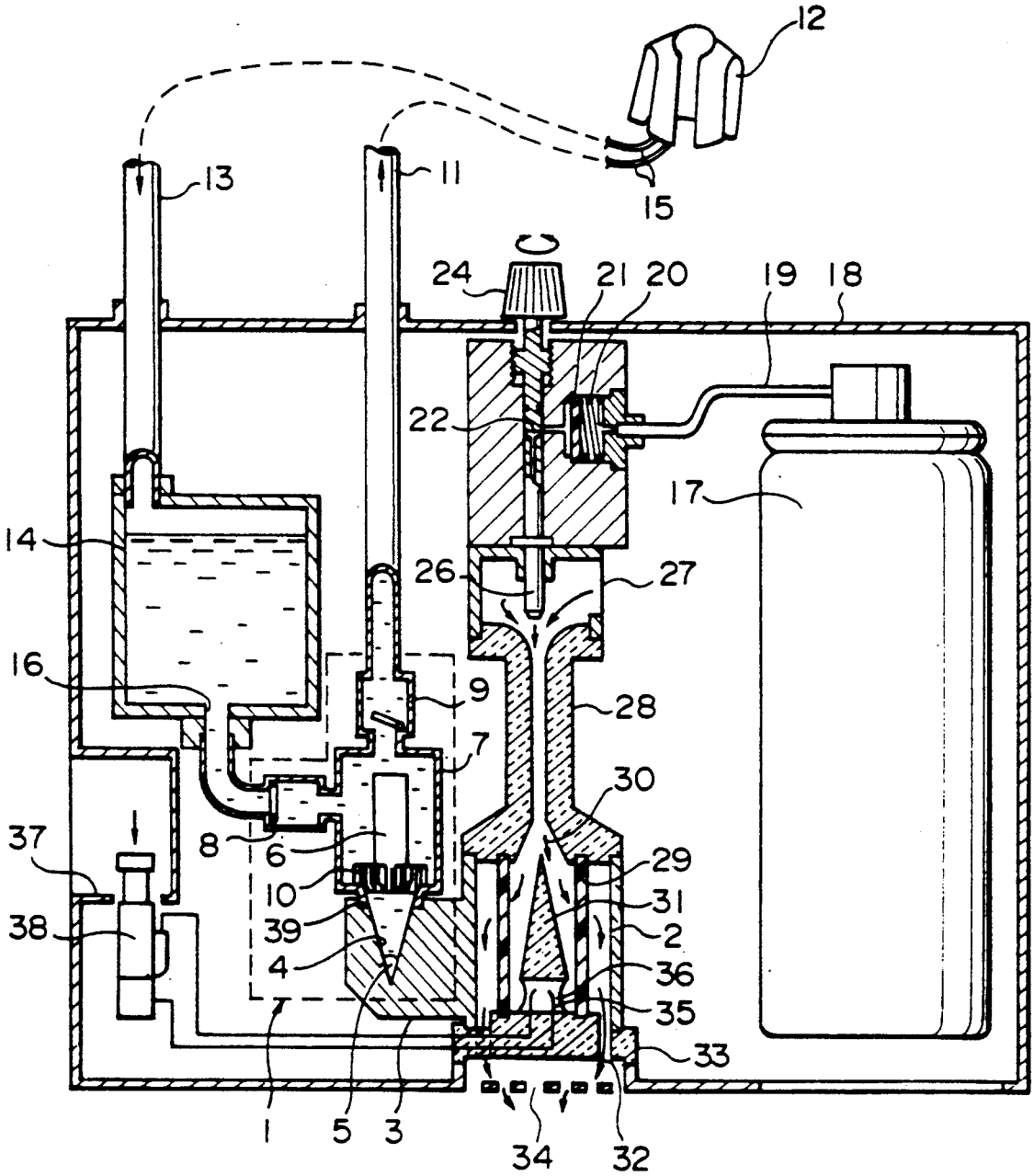
FIG. 1 is a side elevational cross sectional view which illustrates a first embodiment of a heat conducting apparatus according to the present invention.

Referring to the drawing, the portion surrounded by a dashed line corresponds to a heat drive pump 1 suggested in Japanese Patent Application No. 61-144783 by the applicant of the invention. A substantially v-shaped liquid heating recess 4 is formed in a heat drive pump heating portion 3 formed integrally with a combustion chamber 2. When it is heated, liquid enclosed therein vaporizes, so that steam bubbles 5 is formed. The steam bubbles 5 grow in the heating recess 4 into a condensing pipe 6, causing the pressure in a gas-liquid exchanging chamber 7 to increase. Due to the pressure rise, a pump suction side check valve 8 is closed but a pump discharge side check valve 9 is opened. As a result, liquid heated by a degree corresponding to the volume of the steam bubbles is discharged outside from the gas-liquid exchanging chamber 7. On the other hand, the steam bubbles introduced inside are cooled down since the condensing pipe 6 is located in the gas-liquid exchanging chamber 7 and its temperature is lower than that of the steam bubbles. Therefore, the steam bubbles start condensing, causing the pressure in the gas-liquid exchanging chamber 7, to decrease. As a result, the discharge side check valve 9 is closed and the suction side check valve 8 is opened, causing cooled liquid to be introduced into the gas-liquid exchanging chamber 7. When the condensation is commenced, liquid is introduced into the heating recess 4 and also the heating recess 4 is therefore cooled down. Therefore, the condensation further proceeds, resulting in that the steam bubbles completely disappear. Thus, liquid corresponding to the volume of the steam bubbles which have disappeared is introduced from outside into the heat drive pump. A multiplicity of fins 10 located around the base portion of the condensing pipe 6 act to introduce the steam bubbles which have grown from the heating recess 4 due to capillary force generated between fins or between the fin and the condensing pipe 6. The liquid, which has been discharged from the heat drive pump performing the pumping operation when it is simply heated, is also heated because the liquid absorbed heat from the steam bubbles in the gas-liquid exchanging chamber. The heated liquid passes through a discharge pipe 11 so as to be supplied to a member to be heated such a heating suit 12. The liquid, which has heated the member to be heated, passes through a suction pipe 13 and returns to the inside portion of the apparatus. Then, it is accumulated in a feed tank 14 which is communicated with the suction side check valve 8. When the heat drive pump generates the steam bubbles, it also simultaneously separates and generates a noncondensing gas (such as air) dissolved in the liquid. The gas is collected and becomes a large bubble during the period in which it circulates in a closed liquid circuit 15. If the large bubble is sucked by the heat drive pump, there is a fear of stopping the operation of the pump. The feed tank 14 acts to prevent the aforesaid problem. A liquid inlet port 16 is formed in the central portion of the bottom of the tank so as to be present in the liquid regardless of the direction of tilt of the feed tank in order to prevent sucking of the bubbles. Although the liquid in a circulating passage is used in such a manner that the noncondensing gas has been sufficiently removed it is preferable that the noncondensing gas is not completely removed but a slight quantity of it is left in order to hasten the generation of the steam bubbles in the heat drive pump for the purpose of increasing the pump discharge and causing the pump to operate satisfactorily.

A gas cylinder 17 is included in apparatus case 18 and supplies an LPG to a valve chamber 20 via a gas piping 19. The gas passes through a filter 21 located in the valve chamber so as to be supplied to a valve portion 22. The valve portion 22 comprises a valve element having a sealing surface 23 and a knob 24. When the knob 24 is rotated, the valve element is vertically moved by the action of the thread, causing the sealing surface 23 comes in contact with an "O" ring 25 of a nozzle 26 or separated from the same. As a result, the valve is opened/closed. The gas, which has passed through the valve portion 22, is jetted from the nozzle 26 into an ejector pipe 28, causing outer air to be sucked through an air inlet port 27. The ejector pipe 28 is made of material having excellent adiabatic characteristic and is coupled with the combustion chamber 2, the ejector pipe 28 acting to heat-insulate the combustion chamber.

In the combustion chamber, a catalyst mat 29 is cylindrically disposed between the lower end portion of the ejector pipe 28 and a supporting bottom plate 33 for supporting the adiabatic material, so that the overall portion of a mixed gas 30 supplied from the ejector pipe 28 is caused to pass through the mat.

A pyramid-like deflector 31 upwardly projects from the supporting bottom plate 33 so as to form a kind of a diffuser together with the cylindrical catalyst mat 29, so that the mixture gas is equally supplied to the entire surface of the catalyst mat. The mixture gas attains a complete combustion in the catalyst mat and high temperature exhaust gas heats the combustion chamber 2. An exhaust gas 32, the temperature of which has been lowered, passes through a hole formed in the support bottom plate 33 for supporting the adiabatic material. Then, it passes through an exhaust hole 34 formed in the case 18 so as to be discharged outside.

A ignition electrode 35 is disposed in an ignition chamber 36 formed in the base portion of the pyramid-like deflector. A lead wire of it is connected to a piezoelectric device 38 fastened to a side cut portion 37 of the case 18 By depressing the piezoelectric device so as to throw sparks to the ignition electrode to ignite the mixture gas and therefore the mixture gas explodes slightly. The flare of the explosion heats the catalyst mat and thereby the combustion of the catalyst is commenced In a case where the combustion is stopped, the knob 24 may be rotated so as to shut the gas.

The combustion chamber 2 of the thus arranged gas catalyst combustion apparatus is made of excellent heat conductive material such as copper or aluminum and a portion of it is extended so as to also serve as a heating portion of the heat drive pump, so that combustion heat can be satisfactorily conducted to the pump heating portion 3 is enabled. Simultaneously, an opening 39 formed in the liquid heating recess 4 faces upwards with respect to the movement in a state where the apparatus is used in a normal manner. The reason for this lies in that the noncondensing gas such as air, and carbon dioxide and the like can be separated, the noncondensing gas being dissolved in the operating liquid when the steam bubbles 5 is generated in the recess. If the recess portion opening 39 faces downwards with respect to the movement, the noncondensing gas is accumulated in the heating recess 4, causing the introduction of the operating liquid into the recess to be prevented. Therefore, the operation of the pump is undesirably stopped. As described above, there is an operative directional range for the heat drive pump when it is practically used. Therefore, the recess portion opening 39 must face sideway or upwards with respect to the movement in order to prevent the stoppage of the operation of the pump. The portable apparatus according to the present invention is used in various directions with respect to the movement. For example, in a case where it is used as a heating suit, the heat conducting apparatus according to the present invention is fastened to the clothes in such a manner that, assuming that the state where the person who wears it stands or sits down is a normal state, the recess portion opening faces upwards at this time. As a result, pump stoppage can be prevented even if the person who wears it lies down. Thus, no problem arises if the person goes into a headstand.

Figure 2:
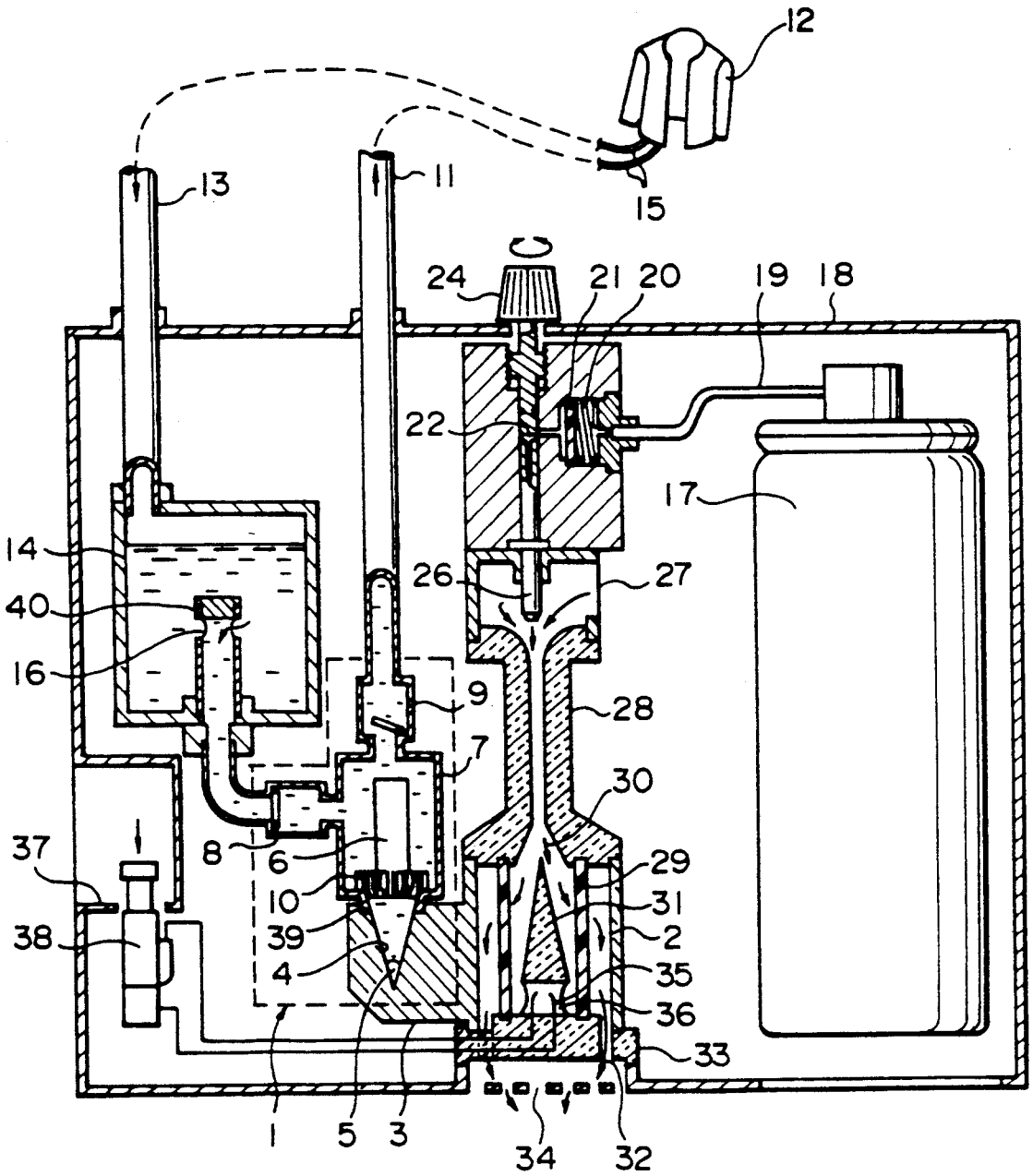
FIG. 2 is a side elevational cross sectional view which illustrates a second embodiment of a heat conducting apparatus according to the present invention.

FIG. 2 illustrates a modification of the apparatus shown in FIG. 1, wherein a liquid inlet pipe 40 projects over the bottom of the feed tank 14 to a position adjacent to the central portion and the inlet port 16 is formed in the side surface of it, so that the liquid is introduced through it so as to be supplied to the heat drive pump. Thus, the introduction of the bubbles can be prevented even if the tank is turned upside down. Therefore, the fear of the operation stop of the heat drive pump can be further avoided.

Figure 3:
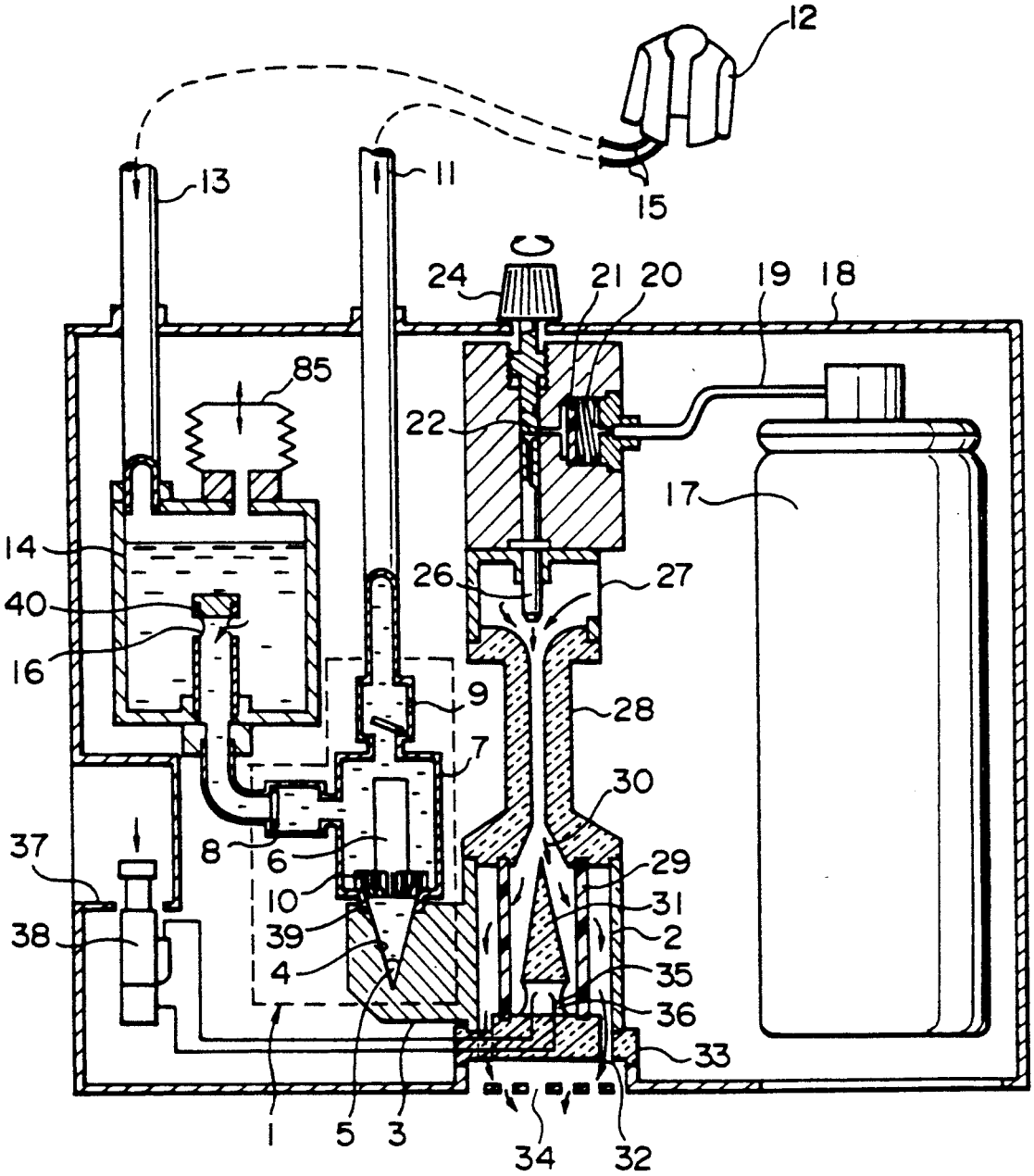
FIG. 3 is a side elevational cross sectional view which illustrates a third embodiment of a heat conducting apparatus according to the present invention.

FIG. 3 illustrates a modification of the structure shown in FIG. 2, wherein a telescopic bellows 85 is outwardly fastened to the top wall of the feed tank 14. The portion in the bellows and the portion in the tank are connected to each other. Thus, a steam pressure relieving apparatus is constituted. The steam pressure relieving apparatus is capable of overcoming a problem when the apparatus, according to the present invention, is operated and the overall body of the closed liquid circuit 15 has been heated, the steam pressure of the liquid is raised by a degree corresponding to the raised temperature. In this situation, the boiling point is raised, the temperature of the heating portion of the heat drive pump is also raised and thereby a temperature adjustment to be described later cannot work as desired. This causes stress to be applied to each junction of the closed liquid circuit. However, the degree of the rise in the steam pressure is countervailed by the increase in the volume of the closed liquid circuit due to the expansion of the bellows 85. A small piston may be used in place of the bellows. The elements, the volume of which i changed such as the bellows or the piston, may be disposed at any position in the closed liquid circuit.

Figure 4:
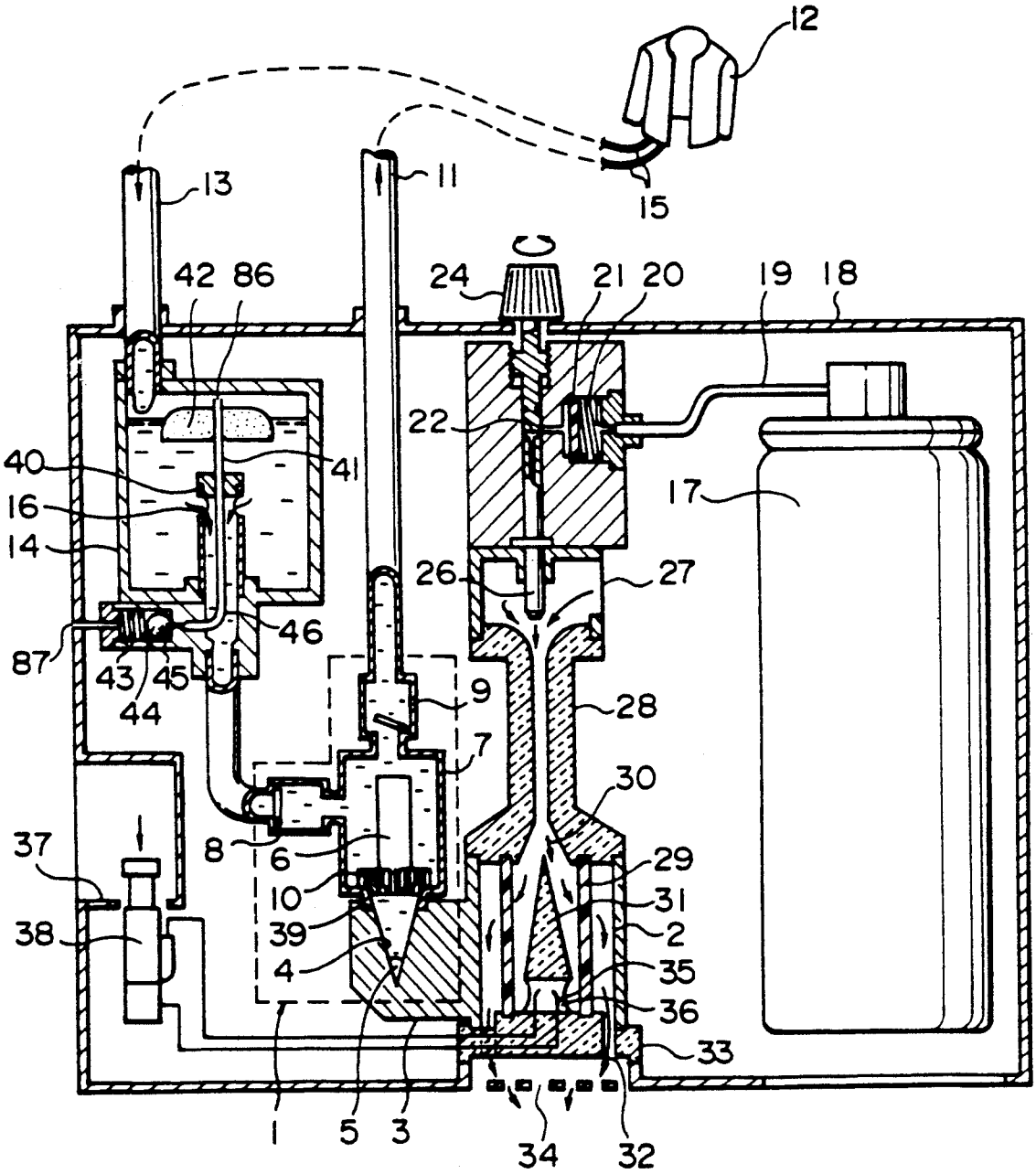
FIG. 4 is a side elevational cross sectional view which illustrates a fourth embodiment of a heat conducting apparatus according to the present invention.

FIG. 4 illustrates another type of the steam pressure relieving apparatus shown in FIG. 3. A flexible rubber thin pipe 41 penetrates an upper closed portion of the liquid inlet pipe 40 which projects to the central portion of the feed tank 14 and extends upwards. A float 42 is fastened to the end portion of the rubber thin pipe 41. An end portion 86 of the rubber thin pipe penetrates the center of the float 42 and it is opened in the surface of the float 42 so as to be communicated with the inside portion of the tank 14. The length of the flexible rubber thin pipe is arranged in such a manner that its float 42 freely moves in the feed tank and the float 42 does not come in contact with the inner wall of the tank. Another end portion of the rubber thin pipe 41 passes through the liquid inlet pipe 40 so as to be connected to a thin pipe 46 fastened to the lower portion of the feed tank 14 and connected to a valve chamber for a check valve 45 composed of a spring 43 and a ball 44. The outlet port of the check valve 45 is connected to a case discharge port 87. As a result, the degree of rise in the steam pressure due to the rise in the temperature of the liquid in the closed liquid circuit after the operation of the apparatus has been commenced can be relieved by outwardly discharging the noncondensing gas accumulated in the closed liquid circuit through the aforesaid check valve 45. Float 42 causes opening portion of the rubber thin pipe 41 communicated with the check valve to be present in the noncondensing gas accumulated in the tank regardless of the direction of the tank In a case where the subject to be heated by the aforesaid apparatus is flexible plastic or a rubber pipe, the outside gas is dissolved in the operating liquid through the wall surface of the pipe or the like, separated by the heat drive pump and accumulated in the feed tank. Therefore, it is a critical factor to outwards discharge it.

The operating liquid can be undesirably discharged from the plastic pipe or the like due to a long time usage of the apparatus according to the present invention, causing its quantity to be reduced. In order to overcome this problem, an operating liquid supply port, to which an access from outside can be made, is formed in the top wall of the feed tank. The operating liquid is supplied through the aforesaid supply port to the feed tank by a simplified pump of a bellow type. Usually the aforesaid supply port must, of course, be closed by a plug.

Figure 5:
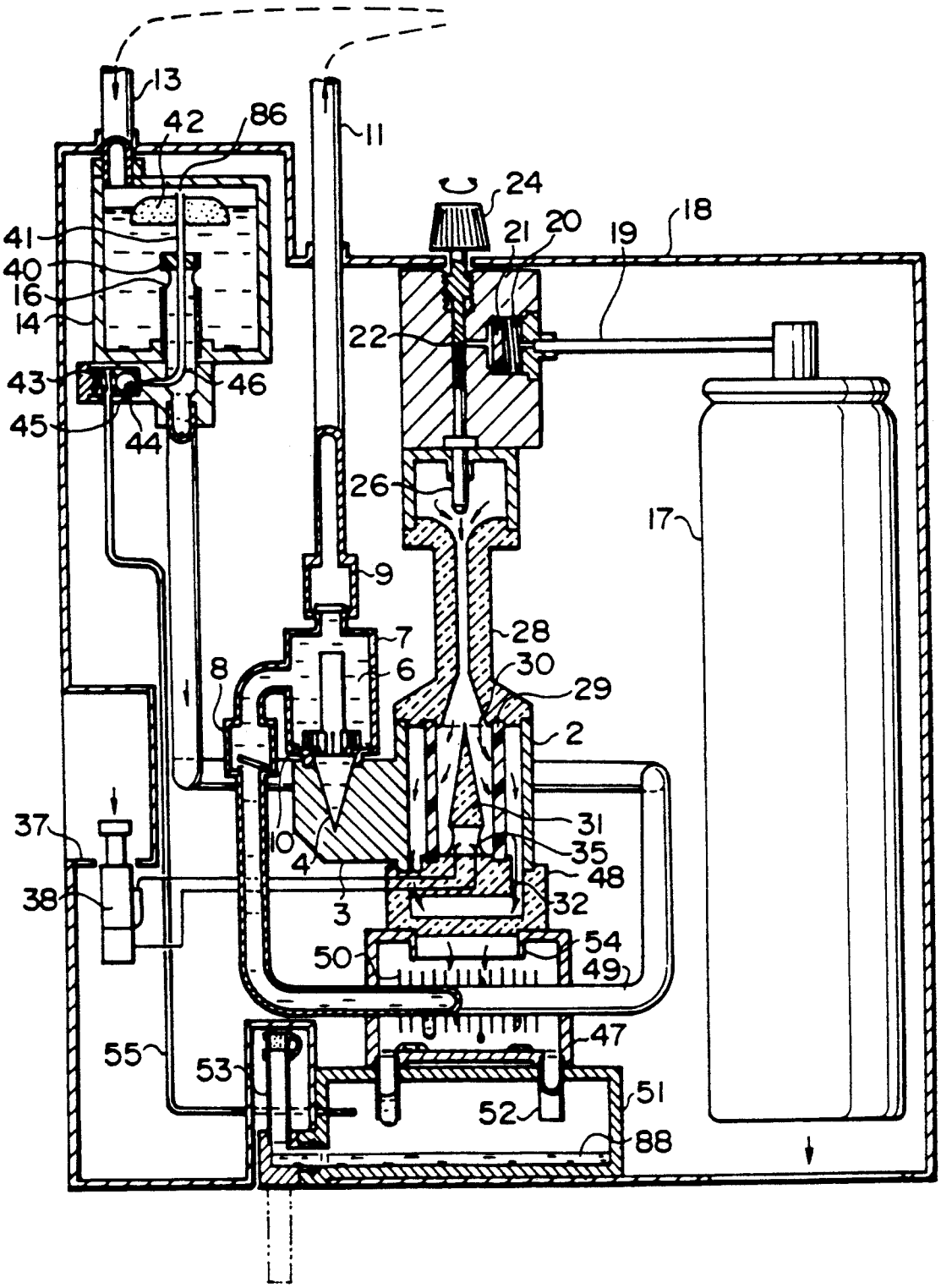
FIG. 5 is a side elevational cross sectional view which illustrates a fifth embodiment of a heat conducting apparatus according to the present invention.

FIG. 5 illustrates an improvement of the apparatus shown in FIGS. 1 and 4. A heat exchanger 47 is connected to the lower surface of the combustion chamber 2 while interposing an adiabatic duct 48. A duct 49 extending from the feed tank 14 penetrates the heat exchanger, the duct 49 being then connected to the heat drive pump. It is preferable that the duct in the heat exchanger be made of material such as copper which is capable of conducting high temperature and simultaneously a multiplicity of heat conducting fins 50 be provided. A drain tank 51 is disposed below the heat exchanger in such a manner that the heat exchanger and the drain tank 51 are communicated with each other by a drain pipe 52. A drain discharging pipe 53 is disposed at the lower end portion of the drain tank 51. A portion of it fastened to the drain tank is rotated, so that the drain is downwardly discharged. A structure enabling the discharge pipe to face downward may be arranged in such a manner that the base portion of the discharge pipe is formed into bellows or the same is made of a flexible rubber pipe or the like. Since an exhaust gas introducing port 54 of the heat exchanger projects into the heat exchanger, the drain accumulated in the heat exchanger does not flow backward toward the combustion chamber 2 regardless of the direction of the overall body of the apparatus. Similarly, since the drain pipe 52 also projects into the drain tank, the backward flow of the drain can be prevented. By fastening the heat exchanger 47 thus structured, the high temperature exhaust thermal energy from the combustor can be conducted to the operating liquid. As a result, the energy utilization efficiency of the overall body of the apparatus can be improved and the temperature of the exhaust gas can be lowered, causing the safety to be secured because a burn can be prevented even if the apparatus is touched with the hand On the other hand, a thin pipe 55 for discharging the gas discharged from the check valve 45 of the steam pressure relieving apparatus shown in FIG. 4 into the drain tank 51 is disposed. Thus, in a case where the feed tank is filled with the liquid, the fear Of wetting the clothes or the like by the operating liquid directly discharged outside from the check valve is eliminated.

Figure 6:
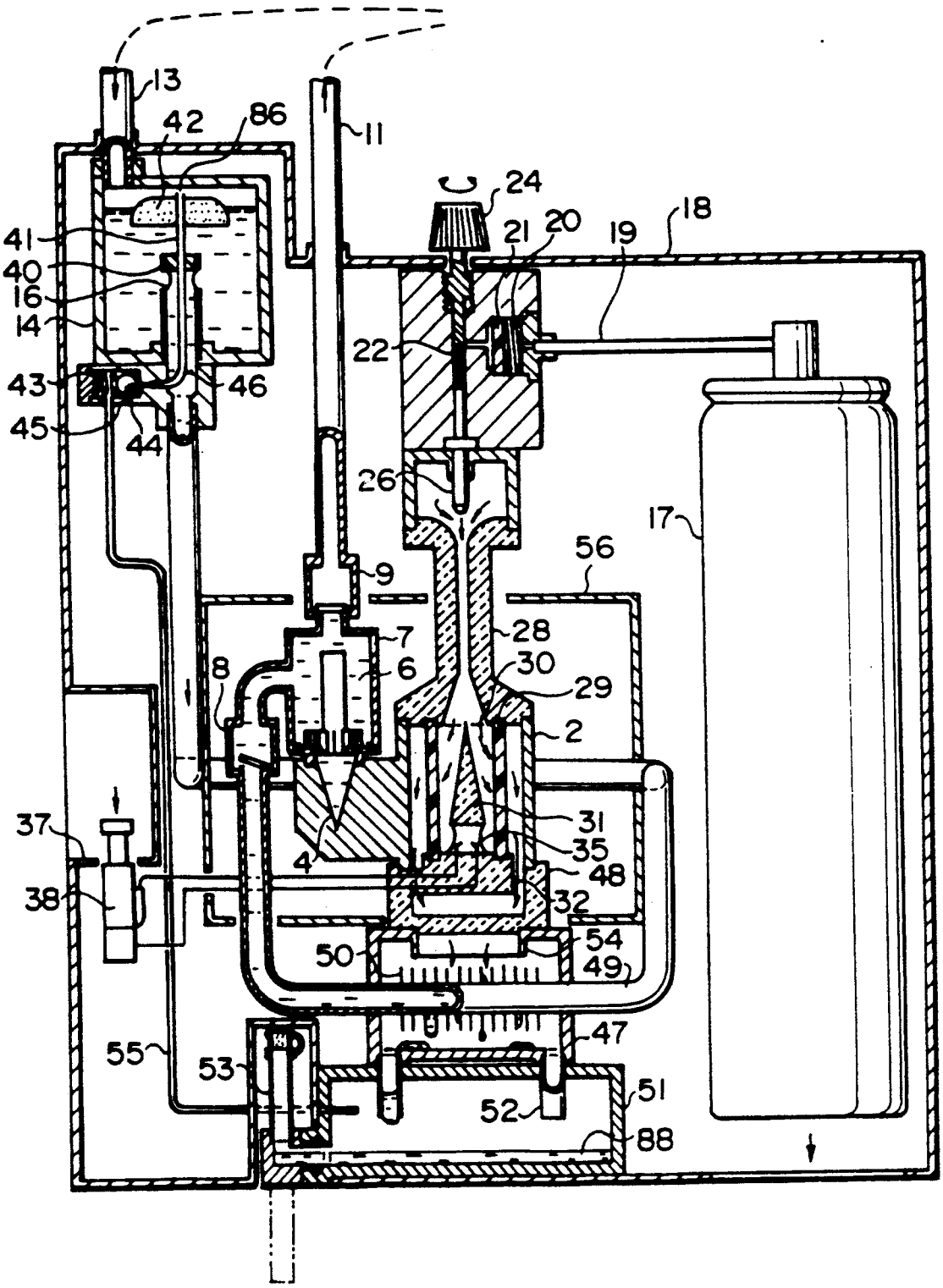
FIG. 6 is a side elevational cross sectional view which illustrates a sixth embodiment of a heat conducting apparatus according to the present invention.

FIG. 6 illustrates a structure arranged in such a manner that the heat drive pump and the combustion chamber are surrounded by a heat insulating box 56 constituted by a plate made of, for example, aluminum which is excellent heat conducting material, the duct 49 extending from the feed tank 14 toward the heat drive pump is arranged around the box while being made in contact with the box, the duct 49 penetrates the heat exchanger 47 and is connected to the heat drive pump. The duct is made of material such as copper which is excellent heat conducting material and therefore heat taken from high temperature portions such as the combustor and the heating portion of the heat drive pump is conducted to the operating liquid in the duct 49 via the box. As a result, the output from the heat drive pump can be enlarged, the quantity of adiabatic material required in the apparatus can be reduced and an excessive rise in the internal temperature can be prevented.

Figure 7:
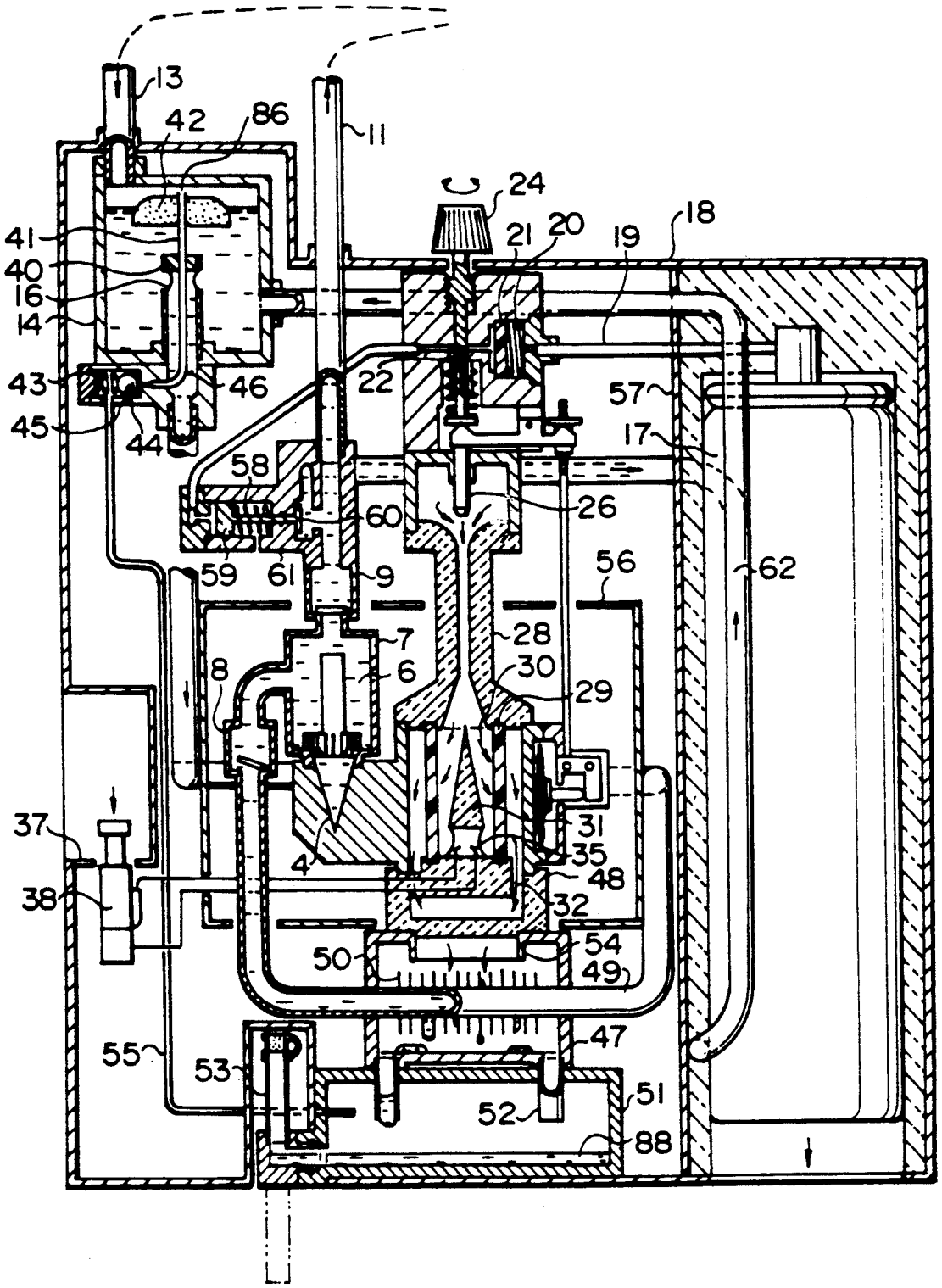
FIG. 7 is a side elevational cross sectional view which illustrates a seventh embodiment of a heat conducting apparatus according to the present invention.

FIG. 7 illustrates an embodiment of the present invention which includes a cylinder heating apparatus. The cylinder heating apparatus has an insulating wall 57 disposed in the case 18 and a gas cylinder chamber, the inner surface of which is applied with adiabatic foam. On the discharge side of the heat drive pump, a liquid passage bypass pressure valve 61 is fastened which has a valve element 60 directly connected with a piston 59 which is communicated with the cylinder via the valve portion 22 and which is operated according to the balance between the pressure of the cylinder and an opposed spring 58. A circuit 62 circulating in the gas cylinder chamber in parallel to the opened liquid circuit and returning to the feed tank is formed. When the pressure valve 61 is opened, hot liquid supplied from the heat drive pump is introduced into the circuit 62, so that the cylinder chamber is heated. Since the heat conducting apparatus according to the present invention is arranged in such a manner that outer air is sucked by the internal pressure of the LPG gas cylinder to make a mixture gas and the exhaust gas is discharged, it is preferable that the internal pressure of the cylinder be constant. However, the LPG in the cylinder is cooled down in proportion to the fact that the heat of vaporization is deprived with the use of the gas, causing the internal pressure to be undesirably lowered. In the cylinder heating apparatus, if the cylinder is cooled down and the internal pressure is lowered below a predetermined value, the opposed spring 58 in the liquid passage bypass pressure valve 61 pushes the piston 59. As a result, the valve element 60 directly connected to it is opened and therefore a portion of the liquid discharged from the heat drive pump is bypassed and introduced into the circuit 62. Then, it heats the cylinder chamber before it returns to the feed tank. After a while, the temperature of the cylinder chamber and that of the cylinder are increased. When the internal pressure of the cylinder is increased, the pressure causes the piston 59 to be moved against the action of the spring 58. As a result, the valve 60 is closed. Thus, the internal pressure level of the cylinder can be maintained in a certain range regardless of the quantity of the gas used and the external temperature.

Figure 8:
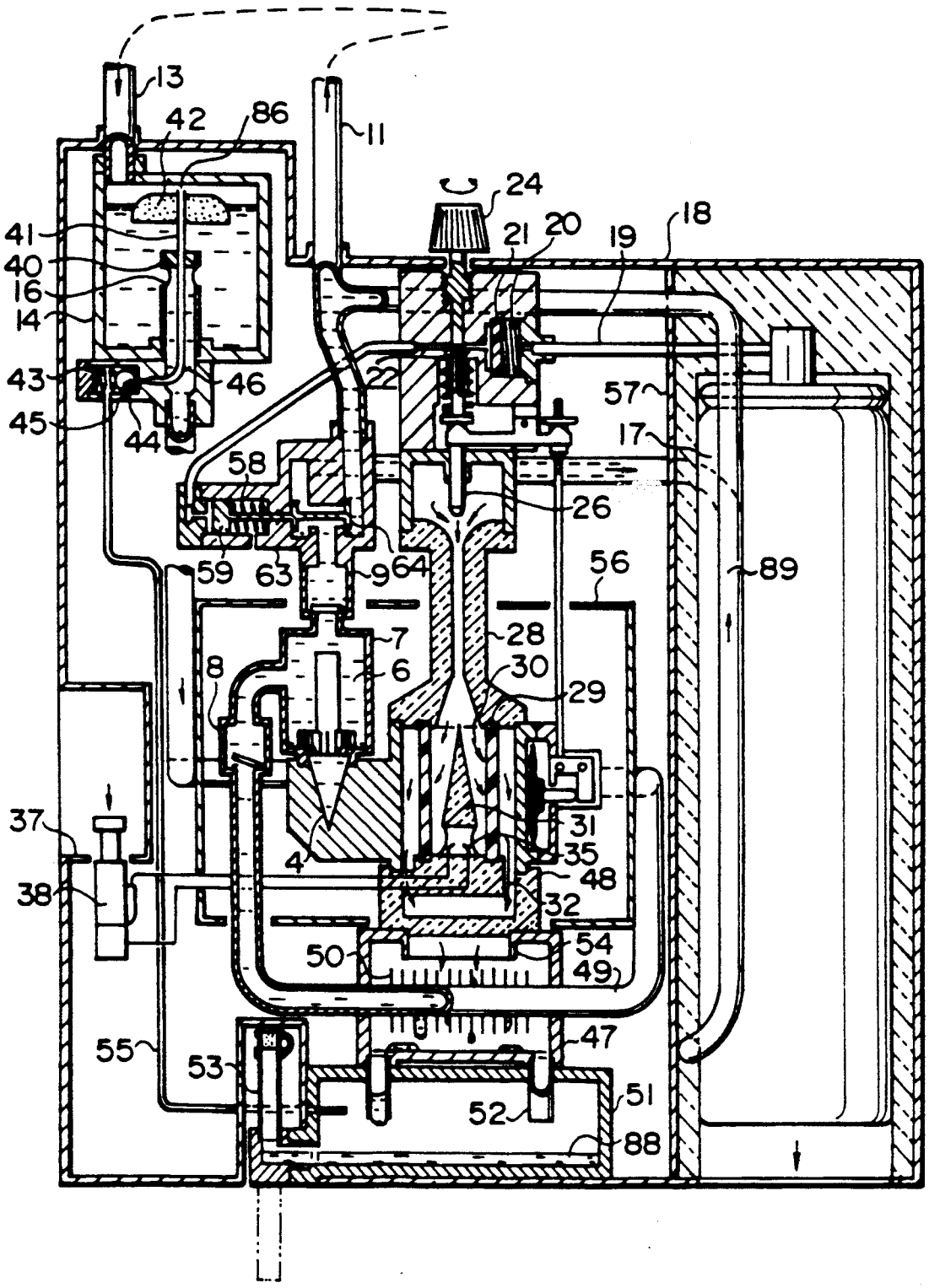
FIG. 8 is a side elevational cross sectional view which illustrates an eighth embodiment of a heat conducting apparatus according to the present invention.

FIG. 8 illustrates another example of the cylinder heating apparatus shown in FIG. 7, wherein a liquid passage switching pressure valve 63 is used in place of the liquid passage bypass pressure valve 61. If the internal pressure level of the cylinder is lowered below a predetermined level, the liquid passage on the discharge side of the heat drive pump is switched to a bypass passage 89 by a switch valve element 64. The bypass passage 89 is arranged to circulate in the gas cylinder chamber before it is connected to the original discharge pipe 11. As a result, the cylinder chamber is heated by the overall portion of the liquid discharged from the heat drive pump. When the internal pressure of the cylinder is increased to a level higher than the predetermined level due to heating, the switching element is switched, so that the overall portion of the liquid discharged from the heat drive pump is directly supplied to the discharge pipe 11. According to this system, the overall portion of the discharged liquid circulates in the cylinder chamber, causing an advantage to be realized in that the internal pressure of the cylinder can be quickly.

Figure 9:
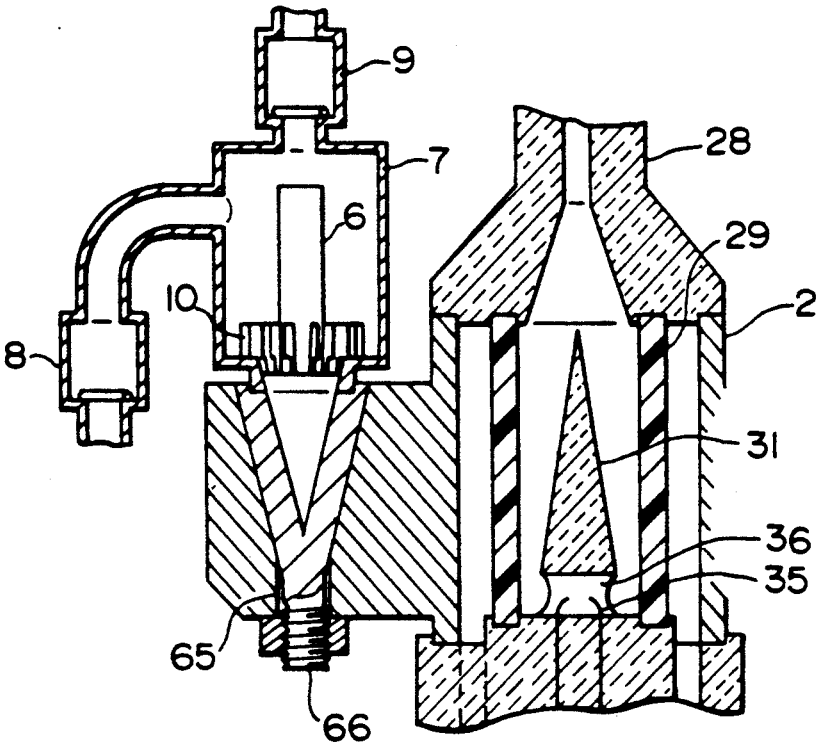
FIG. 9 is a cross sectional view which illustrates an embodiment of a heat drive pump of the heat conducting apparatus according to the present invention.

FIG. 9 illustrates an example in which the combustion chamber 2 and the heat drive pump heating portion 3 are individually manufactured and then they are coupled to each other. A coupling hole 65 is formed in a combustor block and a tapered heating portion 66 is inserted into the coupling hole before it is fastened to the block by means of a nut. According to this example, the contact pressure can be raised and the contact area can be increased, causing heat to be conducted satisfactorily.

Figure 10:
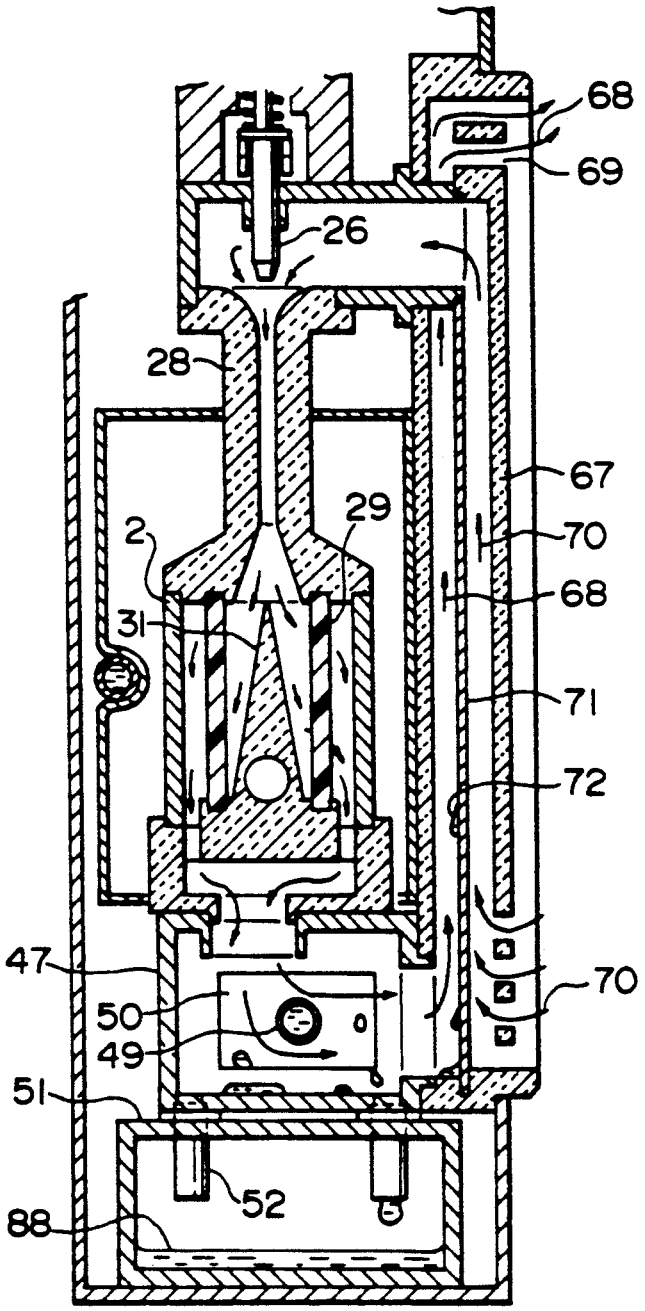
FIG. 10 is a cross sectional view which illustrates a modification of a combustion device of the heat conducting apparatus according to the present invention.

FIG. 10 is a lateral cross sectional view which illustrates a heat conducting apparatus according to the present invention in which the nozzle 26, the ejector pipe 28, the combustion chamber 2 and the heat exchanger 47 and the like are illustrated. Furthermore, a second heat exchanger 67 is illustrated which acts to heat a gas to be sucked into the ejector by utilizing the exhaust gas discharged from the heat exchanger. An exhaust gas 68 discharged from the heat exchanger upward moves in the second heat exchanger and then it is discharged outside through an exhaust hole 69 formed in the top portion of the heat exchanger 67. On the other hand, a sucked gas 70 is sucked through a sucking hole formed in the lower portion of the heat exchanger 67 and then it similarly moves upwards in the second exchanger before it is sucked by the ejector. There is a considerably large temperature difference between the exhaust gas and the sucked air each of which is moving upward. The heat exchange is performed through a thin plate 71 made of material such as aluminum which is excellent heating conducting material. Therefore, the temperature of the exhaust gas is further lowered, while the temperature of the sucked gas is increased. As a result, the heat loss taken outside by the exhaust gas can be decreased. The vapor in the exhaust gas is condensed and water droplets 72 are formed on the surface of the thin plate 71. The water droplets are dropped, and then they are accumulated in the drain tank 51 together with the drain.

The second heat exchanger 67 has the exhaust hole in the upper portion thereof and the suction hole in the lower portion thereof in such a manner that they are located away from each other. Since the sucked gas is heated by the second heat exchanger, the combustion efficiency can be raised to a certain degree.

Figure 11:
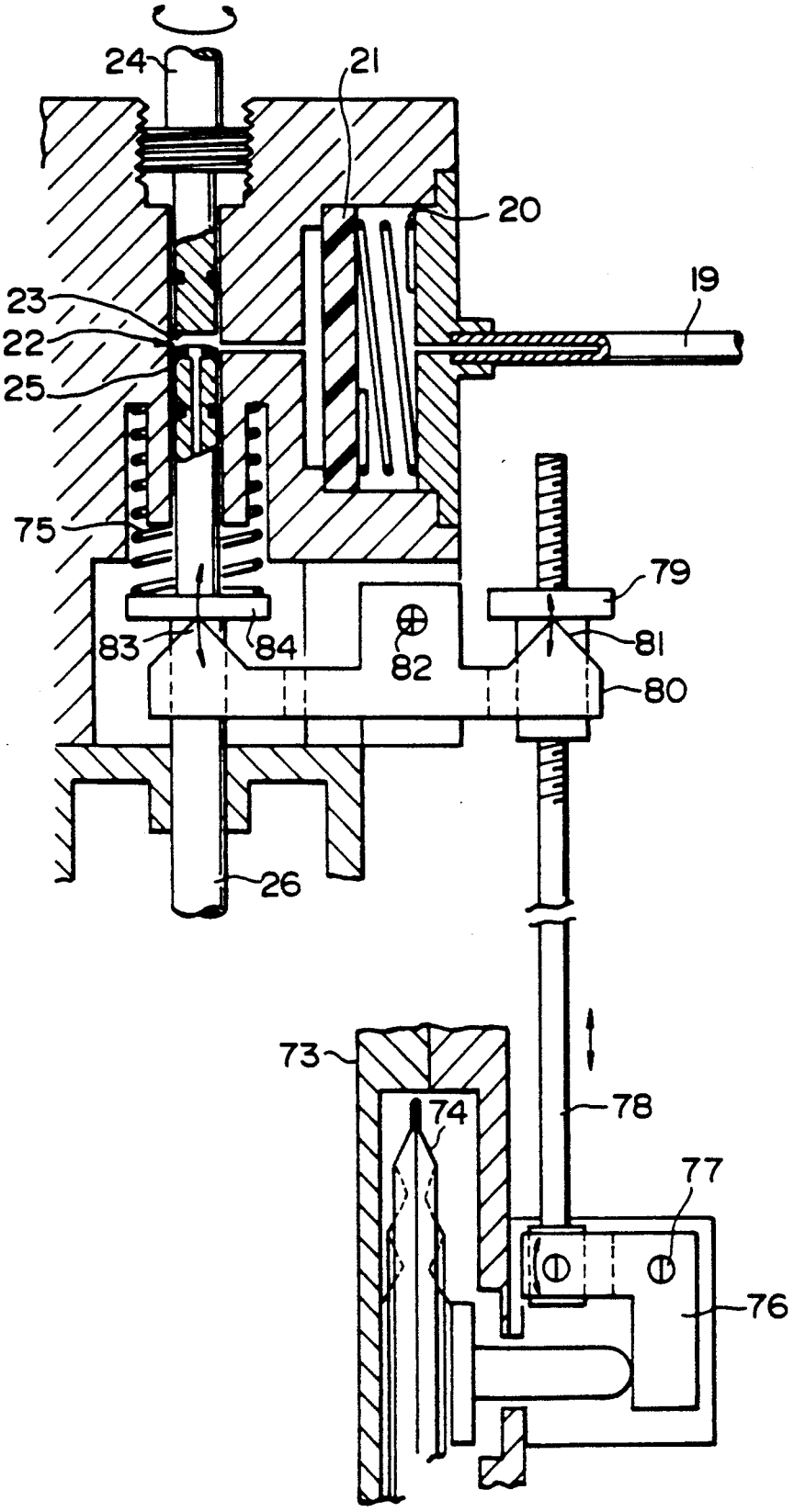
FIG. 11 is a partial cross sectional view which illustrates an example of a gas supply control device of the heat conducting apparatus according to the present invention.

FIG. 11 is a cross sectional view which illustrates a output control portion of the heat conducting apparatus according to the present invention. There is a characteristic that the output from the heat drive pump 1 according to the present invention is in substantially proportion to the temperature of the pump heating portion 3. Since the pump heating portion 3 according to the present invention is thermally integrally formed with the wall of the combustion chamber 2, the output from the pump, that is, the output from the heat conducting apparatus can be controlled by controlling the temperature of the surface of the wall of the combustion chamber 2. According to this embodiment, a diaphragm 74 which is in contact with the wall surface 73 of the combustion chamber 2 and into which liquid is enclosed is disposed in such a manner that it is connected to the nozzle 26. If it has been raised to a level higher than the predetermined temperature level for the wall surface of the combustion chamber 2, the diaphragm 74 is slightly expanded. This displacement is transmitted to an L-shape arm 76, so that it is rotated relative to an arm supporting point 77. As a result, a pull rod 78 pivotally connected to the arm 76 is pulled downwards. The upper portion of the pull rod has a thread to receive an adjustment ring 79 which is therefore moved downward with the pull rod. Since the adjustment ring is in contact with an application point 81 of a level 80 and thus the displacement of the adjustment ring is transmitted to an application point 83 of the level via a level supporting point 82. Therefore, a flange 84 of the nozzle 26, which is in contact with it, is pushed upwards against the action of the opposed spring 75. When the nozzle "O" ring 25 disposed at the top end portion of the nozzle is moved upwards until it comes in contact with the sealing surface 23 of the valve element, the gas is stopped. When the temperature of the wall surface of the combustion chamber is lowered below a predetermined level due to the continuous operation of the heat drive pump, the diaphragm 74 is slightly contracted. Thus, the force of the nozzle opposed spring 75 moves the ring mechanism in the opposite direction and the nozzle 26 is simultaneously moved downward. As a result, the valve portion 22 is opened and the gas is therefore introduced into the nozzle 26. As described above, the temperature of the wall of the combustor can be included in a predetermined temperature range. The predetermined value can be changed by rotating the knob 24 to vertically move the valve element by means of the thread. The adjustment ring 79 acts to perform adjustment in such a manner that the arm moves the nozzle at a proper position at the time of the assembly.

Since the present invention is constituted as described above, water can be heated with the maximum energy efficiency and it can be circulated without problem. Therefore, a significant effect is exhibited when it is used to heat/warm clothes or the like.

A portion heat conducting apparatus for use in a heater or clothes is provided.

There is provided a portable heat conducting apparatus comprising a gas catalyst combustion device having an air sucking ejector including a gas jetting nozzle connected to a gas cylinder via a gas control valve, a combustion catalyst and an igniting device and the like, a heat drive pump including a heating portion having a liquid heating recess and a check valve in each of the discharge side thereof and the suction side thereof. The gas catalyst combustion device has a combustion chamber which accommodates the combustion catalyst, which includes the heat drive pump heating portion and which is made of excellent heat conducting material. An opening portion in the recess formed in the heat drive pump heating portion is located to face upwards with respect to gravity and the heat conducting apparatus further includes an operating-liquid circulating closed-circuit which is composed by connecting a feed tank, the heat drive pump and the external subject to be heated in series.

I claim:

1. A portable heat conducting apparatus for heating an external subject, said apparatus comprising:
- a feed tank for holding an operating liquid;
- a heat drive pump having a discharge side and a suction side, said heat drive pump including,
  - a heating portion with a liquid heating recess,
  - a check valve in said discharge side of said heat drive pump,
  - a check valve in said suction side of said heat drive pump, and
  - said liquid heating recess receiving operating liquid from said feed tank via said check valve in said suction side of said heat drive pump, and an opening portion of said liquid heating recess facing upward with respect to gravity during normal use of said apparatus;
- a gas catalyst combustion device including,
  - an air sucking ejector including a gas jetting nozzle, said gas jetting nozzle being connected to a gas cylinder via a gas control valve, and
  - a combustion chamber for receiving gas from said air sucking ejector via said gas jetting nozzle, said combustion chamber made of a heat conducting material, said combustion chamber including,
    - a combustion catalyst,
    - an igniting device, and
    - said liquid heating portion of said heat drive pump; and
- connecting means for connecting in series said feed tank, said heat drive pump, and said external subject to be heated to form an operating-liquid circulating closed-circuit.

2. A portable heat conducting apparatus according to claim 1, wherein said combustion catalyst is cylindrical in shape and said combustion chamber further includes a pyramid-like deflector disposed in said cylindrical combustion catalyst.

3. A portable heat conducting apparatus according to claim 1, wherein a pipe projects into said feed tank for supplying operating liquid to said heat drive pump via said check valve in said suction side.

4. A portable heat conducting apparatus according to claim 3, wherein a flexible thin pipe is disposed in said feed tank, a float is fastened to an end of said flexible thin pipe, said thin pipe communicates with an inner upper portion of said feed tank via said end connected to said float, and another end of said flexible thin pipe is connected to a check valve disposed outside said feed tank.

5. A portable heat conducting apparatus according to claim 4, wherein said feed tank includes an operating liquid supplying hole.

6. A portable heat conducting apparatus according to claim 1, further comprising at least one volume changeable element connected to said operating-liquid circulating closed-circuit.

7. A portable heat conducting apparatus according to claim 1, wherein a heat exchanger is disposed in at least one of an up stream and a down steam position from said heat drive pump in said operating-liquid circulating closed-circuit, said combustion chamber includes an exhaust gas hole, a duct made of adiabatic material connects said heat exchanger and said exhaust hole of said catalyst combustor, a drain tank is disposed below said heat exchanger, and an exhaust pipe connects said drain tank with an inside portion of said heat exchanger.

8. A portable heat conducting apparatus according to claim 7, wherein said exhaust pipe projects into said heat exchanger and projects into said drain tank to discharge operating liquid accumulated in said heat exchanger.

9. A portable heat conducting apparatus according to claim 7 or 8, wherein a box surrounds said combustion chamber and said heat drive pump, said box is made of excellent heat conducting metal plate, and a portion of said operating-liquid circulating closed-circuit up stream from said heat exchanger is positioned in contact with the surface of said box.

10. A portable heat conducting apparatus according to claim 7 or 8 further comprising a discharging pipe for properly discharging water accumulated in said drain tank.

11. A portable heat conducting apparatus according to claim 7 or 8, wherein a second stage heat exchanger receives exhaust gas from said heat exchanger and air introduced from outside, which is allowed to pass through said second stage heat exchanger.

12. A portable heat conducting apparatus according to claim 6, wherein said volume changeable element includes one of a bellows and a piston.

13. A portable heat conducting apparatus according to any one of claims 1 to 8, further comprising:

a chamber for accommodating said gas cylinder, a second valve disposed down stream in said operating-liquid circulating closed-circuit form said check valve in said discharge side of said heat drive pump, said second valve including, an opposing spring, a second volume changeable element, and a valve element connected to said second volume changeable element which is operated according to a balance between a pressure of gas supplied by said gas cylinder and said opposing spring, and a closed circuit, formed in parallel with said operating-liquid circulating closed-circuit, circulating operating liquid in said gas cylinder accommodating chamber before being connected to an inside portion of said feed tank.

14. A portable heat conducting apparatus according to claim 13, wherein said second volume changeable element includes one of a bellows and a piston.

15. A portable heat conducting apparatus according to any one of claims 1 to 8, further comprising:

a chamber for accommodating said gas cylinder, a switch valve disposed up stream in said operating-liquid circulating closed-circuit form said check valve in said discharge side of said heat drive pump and having a valve element connected to a third volume changeable element which is operated according to a balance between a pressure of a gas supplied by said gas cylinder and an opposing spring, and a bypass passage which bypasses said operating-liquid circulating closed-circuit circulates through said gas cylinder accommodating chamber before connecting to said discharge pipe of said heat drive pump, and said bypass passage receiving operating liquid when said switch valve operates.

16. A portable heat conducting apparatus according to claim 15, wherein said third volume changeable element includes one of a bellows and a piston.

17. A portable heat conducting apparatus according to any one of claims 1 to 8, wherein said heating portion of said heat drive pump is individually formed form said combustion chamber and is connected to said combustion chamber by a lower threaded section and a nut to secure said heating portion to said combustion chamber.

18. A portable heat conducting apparatus according to any one of claim 1 to 8, further comprising:

a diaphragm positioned in contact with the outer wall of said combustion chamber, said diaphragm expanding/contracting in response to a temperature change of said heat drive pump;

a link mechanism connected to said diaphragm and operationally connected to said gas jetting nozzle and said gas control valve so that gas is jetted/-stopped to maintain said combustion chamber at a predetermined temperature.

19. A portable heat conducting apparatus according to claim 18, further comprising a user adjustable element for adjusting an operational connection between said link mechanism and said gas jetting nozzle.

* * * * *